United States Patent [19]

van der Lely et al.

[11] 3,994,060

[45] Nov. 30, 1976

[54] METHODS AND PRODUCTION LINES FOR THE MANUFACTURE OF PREFABRICATED BUILDINGS

[76] Inventors: Cornelis van der Lely, 7, Bruschenrain, Zug; Hendricus Jacobus Cornelis Nieuwenhoven, Hirsattelweg, 6340 Baar, both of Switzerland

[22] Filed: Nov. 18, 1974

[21] Appl. No.: 524,993

Related U.S. Application Data

[63] Continuation of Ser. No. 292,872, Sept. 28, 1972, abandoned.

[30] Foreign Application Priority Data

Oct. 1, 1971 Netherlands ..... 7113480

[52] U.S. Cl. ..... 29/430; 29/200 A

[51] Int. Cl.[2] ..... B23P 21/00

[58] Field of Search ..... 29/430, 429, 200 A, 29/469; 52/747, 79, 284

[56] References Cited

UNITED STATES PATENTS

| | | | |
|---|---|---|---|
| 2,222,037 | 11/1940 | Lafferty | 52/745 |
| 2,852,931 | 9/1958 | Bonet | 52/745 |
| 3,225,434 | 12/1965 | Van der Lely et al | 29/200 A |
| 3,399,445 | 9/1968 | Carroll | 29/200 A |
| 3,555,763 | 1/1971 | Bloxom | 52/745 |
| 3,574,920 | 4/1971 | Stirling et al. | 29/430 |
| 3,600,870 | 8/1971 | Greenhalgh | 52/745 |
| 3,611,533 | 10/1971 | Thomason | 29/469 |
| 3,685,129 | 8/1972 | Jureit et al. | 29/430 |

*Primary Examiner*—C.W. Lanham
*Assistant Examiner*—Dan C. Crane
*Attorney, Agent, or Firm*—Mason, Mason & Albright

[57] ABSTRACT

A method of manufacturing prefabricated sections for buildings wherein metal frames have concrete cast between them which is heated and allowed to harden along a manufacturing line to form floor and wall components. Ceiling components with metal frames and, where applicable, roof components are also constructed in the manufacturing line. At the end of the manufacturing line, the floor, wall, ceiling and/or roof components are connected, form the desired section and moved onto an adjacent assembly line which is at right angles to the manufacturing line without altering the relative disposition of the sections whereby the longer sides of the section which were parallel to the length of the manufacturing line are carried transversely on the assembly line. The sections on the assembly line are connected together in the relationship they will bear in the finished building and doors, windows, panels and the like are added as the connected sections move along the assembly line from adjacent storage areas. Subsequently, the sections are disconnected and transported separately to the building site where they are assembled and connected.

29 Claims, 4 Drawing Figures

METHODS AND PRODUCTION LINES FOR THE MANUFACTURE OF PREFABRICATED BUILDINGS

This is continuation of application Ser. No. 292,872, filed Sept. 28, 1972, now abandoned.

SUMMARY OF THE INVENTION

This invention relates to methods of manufacturing prefabricated building sections or room units and to production lines for implementing such methods.

According to the invention, there is provided a method of manufacturing prefabricated building sections or room units destined for use in the construction of prefabricated building, wherein the method comprises the steps of forming panel elements by providing a concrete or like cementitions filling between metal beams, conveying the formed elements to a mounting depot or station, and welding the beams of said elements to one another at said depot or station to produce building sections or room units of cellular form for subsequent operations on an assembly line.

BRIEF DESCRIPTION OF THE DRAWINGS

For a better understanding of the invention, and to show how the same may be carried into effect, reference will now be made, by way of example, to the accompanying drawings, in which.

DESCRIPTION OF THE PREFERRED EMBODIMENT

Figure 1:
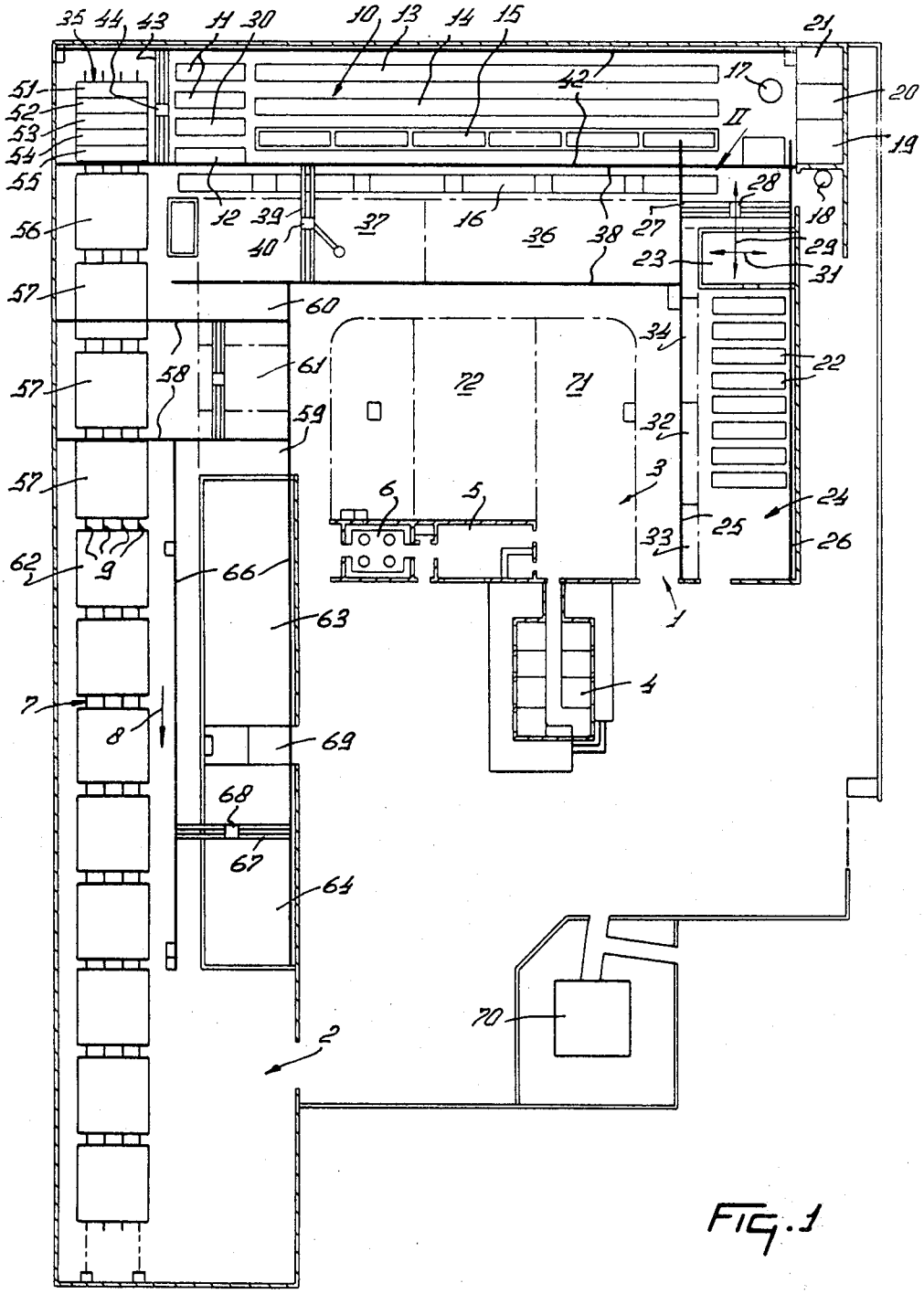
FIG. 1 is a plan view of the floor of a factory arranged for the manufacture of prefabricated building sections by a method in accordance with the invention.

Referring to FIG. 1 of the drawings, a factory floor 1 is illustrated in plan view, said floor being provided with a production line which is generally L-shaped. The floor 1 has a long section 2 which comprises an assembly line 7 and a short section 3 which accommodates the greater part of a manufacturing line 10, said lines 7 and 10 extending generally at right-angles and optionally being located at different horizontal levels. Various stores and other depots are provided along the two lines 7 and 10 which together constitute the production line of the factory. The short section 3 includes an office 4 having direct access to the floor 1, a canteen and cloakroom 5 and a wash room 6 with toilet facilities.

Figure 3:
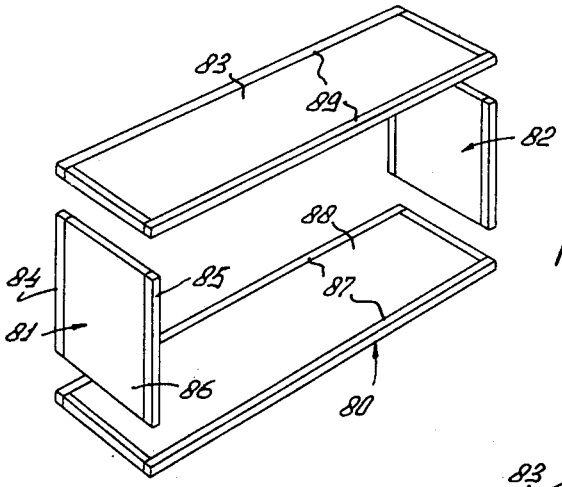
FIG. 3 is an exploded perspective view illustrating the principal elements of a prefabricated building section manufactured by a method in accordance with the invention, and FIG. 4 corresponds to FIG. 3 but shows said elements secured to one another to complete the section.
Figure 4:
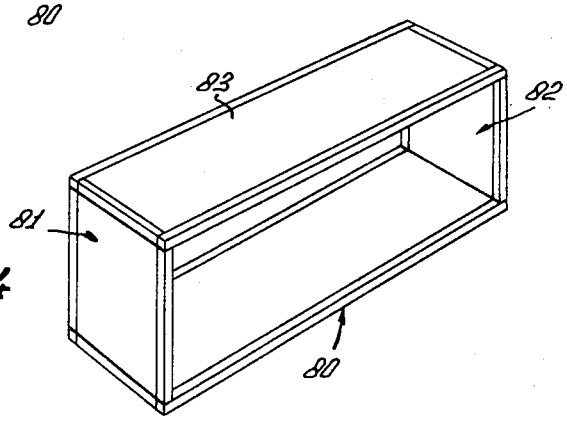

At one corner of the floor 1 there is a depot or station 35 located at the head of the assembly line 7 in the long section 2 of the floor, said depot or station 35 also being at one end of the manufacturing line 10 and being fitted for the assembly of prefabricated panel elements to form cell-like building sections or room units intended for the construction of prefabricated dwelling or other buildings. The term "cell-like building sections or room units" is to be interpreted as implying the provision of at least one wall and/or a floor and/or a ceiling. Once assembled, said building sections or room uniits are conveyed along the assembly line 7 in common and are there provided with wallpaper or other wall coverings, doors, windows and so on as required. Each building section or room unit is composed of a plurality of panel-like elements and normally will basically consist, as shown in FIGS. 3 and 4 of the drawings, of a floor 80, upright walls 81 and 82 and a ceiling 83. Building sections or room units that are to be used in the uppermost story of a dwelling or other building or in a bungalow or other one story building, are also provided with a roof layer in addition to the ceiling 83.

The assembly line 7 has four parallel rails 9 which afford lower conveying means of the conveying line of the factory and the building sections or room units that have been connected to one another at the depot or station 35 are moved step-by-step along the rails 9. The panel-like elements that afford the floors, walls and ceilings 80, 81, 82 and 83 together with roof layers and other parts are constructed along the manufacturing line 10 which line, as previously mentioned, terminates at the depot or station 35 at the head of the assembly line 7, said two lines 7 and 10 thus joining one another at right-angles. A buffer depot or station of the manufacturing line 10 is furnished where that line joins the assembly line 7, Said buffer depot or station being intended for the temporary storage of substantially completed panel-like elements that are ready for use in the assembly line 7. To this end, the buffer depot or station comprises two intermediate stores 11 for walls 81 and 82, an intermediate store 12 for ceilings 83 and an intermediate store 30 for floors 80. The manufacturing line 10 has four sublines 13, 14, 15 and 16, the sub-lines 13 and 14 serving for the manufacture of the walls 81 and 82 while the sub-lines 15 and 16 serve for the manufacture of the floors or ceilings 80 and 83 or both.

The walls 81 and 82 (FIGS. 3 and 4) are afforded principally by two parallel metal beams 84 and 85 at the opposite edges of a concrete filling 86. the sub-lines 13 and 14 are accordingly provided with moulds shaped to receive the beams 84 and 85 and it will be noted that, prior to the casting of the concrete fillings 86, reinforcements and pipes or other ducts for electricity, gas, water central heating and so on may be laid inside the moulds so that said reinforcements, pips and ducts will be substantially concealed from view in the finished buildings of which the walls 81 and 82 are to form parts. Each floor 80 consists of an oblong frame 87 of metal beams provided with a concrete filling 88. In order to make these floors 80, the sub-line 15 is provided with metallic moulds and the frames 87 are placed on metal plates or other metal sheets of those moulds and the concrete of the filling 88 is subsequently poured into the frames 87. The ceilings 83 are made on the sub-line 16 and each ceiling consists principally of an oblong frame 89 of metal beams which frame is provided with a filling. The fillings may be inserted into the ceiling frames 89 in the form of prefabricated sheets or they may be fastened to the frames. If the building section or room unit of which the ceiling 83 forms a part is not to be a section or unit of a building story having a roof, then it may be sufficient merely to fasten the ceiling sheets to the frames 89. If, on the other hand, the building sections or room units are to be parts of single story buildings or of the uppermost storys of multi-story buildings, then it is greatly preferred that the ceilings 83 should be provided with roof layers.

The end of the manufacturing line 10 remote from the depot or station 35 is provided with four reservoirs 18, 19, 20 and 21 and these reservoirs hold cement, sand, gravel and other minor concrete constituents, such as coloring materials, plasticizers and so on, respectively. The materials which have just been mentioned are fed in appropriate proportions to a concrete mixer 17 from the delivery orifice of which concrete is supplied ready for pouring into the moulds of the sub-lines 13, 14, 15 and 16. The rectangular frames 87 and 89 for the floors 80 and ceilings 83 are constructed on an assembly line 24 which comprises a plurality of jigs 22 and appropriate welding sets. Lengths of beam are cut to size and are then assembled in the jigs 22 and welded together to form the frames 87 and 89. Teh completed frames 87 and 89 are conveyed from the assembly line 24 to the receiving ends of the sub-lines 15 and 16 by way of a depot or station 23. The depot or station 23 is provided to enable the frames 87 and 89 to be provided with a rust-proofing or other anti-oxidant composition when this is considered to be necessary. The composition could, for example, be tar or some other bituminous material or paint or a synthetic plastics composition. The assembly line 24 is furnished with an overhead crane 27 that is movable along two spaced apart rails 25 and 26. The crane 27 includes a transverse gantry or so-called crane crab 28 so that hoisting gear of the crane 27 can be moved to substantially any point lengthwise or laterally of the assembly line 24 by an appropriate combination of the longitudinal movement 29 that is possible along the rails 25 and 26 and the lateral movement 31 that is possible across the gantry 28.

Figure 2:
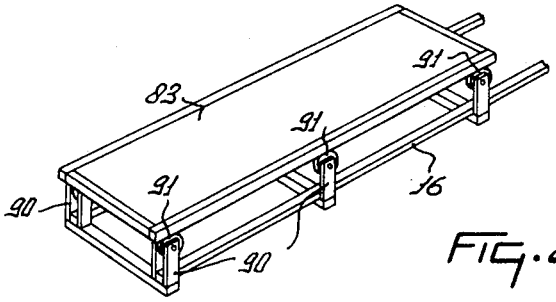
FIG. 2 is a perspective view, to an enlarged scale, of part of a conveyor line of the factory of FIG. 1.

The lengths of beams from which the frames 87 and 89 are formed are cut to size at a depot or station 32 at one side of the assembly line 24, stores 33 and 34 for the beams and for other materials such as welding rods and the like being provided adjacent the depot or station 32. The crane 27 is employed to move the cut beam sections from the depot or station 32 to the jigs 22 and is also used to move the completed frames 87 and 89 from those jigs through the rust-proofing depot or station 23 to the receiving ends of the sub-lines 15 and 16. The sub-line 16 is equipped with a roller conveyor having two parallel rows of rollers 91 (FIG. 2) carried by upright supports 90. The roller conveyor of the sub-line 16 affords further lower conveying means. The ceiling frames 89 are placed on the roller conveyor and are moved step-by-step towards the intermediate store 12. The frames 89 may be provided at various depots along the length of the sub-line 16 not only with the ceiling sheets but also with members such as struts, roof layers and actual roof structures. Consequently, at the delivery end of the sub-line 16, the ceilings 83 are almost completed. Stores 36 and 37 flank the sub-line 16 and contain supplies of the ceiling sheets, struts and foofing parts that have just been mentioned. An overhead crane 39 that is movable along rails 38 is mounted above the stores 36 and 37 and, like the crane 27, includes a transverse gantry or crane crab 40 to enable hoisting gear of the crane 39 to be employed anywhere between the two rails 38 by an appropriate combination of longitudinal and lateral motions. The crane 39 is employed principally for supplying heavy parts from the stores 36 and 37 to the sub-line 16 and for moving the completed ceilings 83 from that sub-line to the intermediate store 12. A further overhead crane 43 is movable longitudinally of the manufacturing line 10 on rails 42 and laterally of that line with the aid of a transverse gantry or crane crab 44. It will be noted that the rails 42 extend over the mounting depot or station 35 of the assembly line 7 so that the hoisting gear of the crane can be employed to deliver walls, floors and ceilings from the intermediate stores 11, 12 and 30 direct to the mounting depot or station 35. Said walls, floors and ceilings 80 to 83 are assembled at the mounting depot or station 35 to form the building sections or room units. The same crane 43 may be employed to move skips or other containers of liquid concrete from the mixer 17 to the various molds on the three-sub-lines 13, 14 and 15. The crane 43 and its rails 42 afford conveying means whose path of possible movement crosses that defined by the four rails 9. It is advantageous to provide ducts beneath the sub-lines 13, 14 and 15 for passing hot air to speed up the setting and hardening of the concrete. The hot air may be supplied from a central heater and blower at the receiving end of the manufacturing line 10 and may serve the additional function of heating the enclosed factory space during cold weather.

The moulds on the three sub-lines 13, 14 and 15 are so disposed that the floors and walls which are produced thereby are already correctly orientated with regard to the positions which they should occupy when they reach the mounting depot or station 35. The floors and walls 80 to 82 remain in their correct dispositions during their temporary lodgment, as will usually be necessary, in the intermediate stores 11 and 30 and can subsequently continue from those temporary stores to the mounting depot or station 35 without needing to be turned or otherwise substantially changed in disposition. The same is true of the ceilings 83 manufactured on the sub-line 16 and transported from that sub-line to the depot or station 35 by way of the intermediate store 12. After being lifted out of their moulds, the walls 81 and 82 are turned from substantially horizontal to substantially vertical positions which are such that they are correctly orientated for their final destinations in the building sections or room units. It is advantageous that the floor to ceiling height of the factory in the region of the manufacturing line 10 should be greater than the equivalent height in the region of the assembly line 7 in order to give adequate room for the mounting or assembly of the prefabricated panel elements at the depot or station 35 and to enable the walls 81 and 82 to be transported without difficulty in vertical dispositions between the delivery end of the line 10 and the receiving end of the line 7. It will be clear from FIG. 1 of the drawings that the assembly line 7 and the manufacturing line 10 have a combined length which considerably exceeds that of the factory floor 1, the latter length being substantially equivalent to the length of the assembly line 7 alone. As previously mentioned, the lines 7 and 10 together form a production line and this production line also includes the subsidiary assembly line 24 for the principal metallic portions of the building sections or room units.

The floors 80, walls 81 and 82 and ceilings 83 are joined together to form prefabricated building sections or room units, substantially as illustrated in FIG. 4 of the drawings, at the mounting depot or station 35 by welding the ends of the beams 84 and 85 to the beams at the corners of the oblong floors and ceilings 80 and 83. FIG. 1 of the drawings diagrammatically illustrates five juxtaposed building sections or room units 51, 52, 53, 54 and 55 which sections or units together form at least part of a one-story building such, for example, as a bungalow. Each section or unit has the basic shape of a rectangular parallelepiped and, as previously mentioned, is afforded principally by one floor 80, two opposite walls 81 and 82 and one ceiling 83 as shown in FIG. 4 of the drawings. This cell-like frame constitutes the rigid supporting structure of the prefabricated section or unit but may, of course, be provided with internal partition walls and the like, there being facilities for the production of such partition walls and the like on the sub-lines 13 and 14 of the manufacturing line 10. The juxtaposed sections or units 51 to 55 are moved step-by-step along the rails 9 of the assembly line 7 in the direction indicated by an arrow 8 in FIG. 1 of the drawings. Accordingly, the juxtaposed sections or units 51 to 55 arrive successively at depots or stations 56 and 57 where further parts are added to the sections or units 51 to 55 which sections or units are bolted, clamped or otherwise releasably secured to one another in the same relative positions as they will occupy in the finished bungalow or other building. The further parts which have just been mentioned include, for example, further roofing, doors and windows, interior floor, wall and ceiling coverings such as tiles, carpets, wallpaper, synthetic plastics wall coverings and so on. The necessary supplies for this purpose can be brought from stores 59, 60 and 61 by an overhead crane movable along rails 58 in substantially the same manner as the previously described cranes 27, 39 and 43.

Upon reaching a depot or station 62, kitchen equipment and sanitary ware are supplied and installed, the necessary appliances being kept in component stores 63 and 64 and in a smaller store 69 having direct access to an open region of the floor 1. An overhead hoisting crane 67 is movable along rails 66 over the three stores 63, 64 and 69 and can move appliances and other heavy items between various points in those stores, as required, with the aid of a laterally movable gantry or crane crab 68 in the same manner as has previously been described in connection with the other overhead cranes. Further depots or stations along the assembly line 7 are provided with equipment for installing external paintwork and other finishes so that the building sections or room units may be substantially completely finished when the delivery end of the line 7 is reached.

As previously mentioned, the sections or units 51, 52, 53, 54 and 55 are temporarily interconnected during their passage along the line 7 and together form a complete bungalow or at least one of a dwelling or other building. At the delivery end of the line 7, the temporary connections between the five sections or units are released so that the sections or units can be separately transported to storage or erection sites for permanent (in most cases) re-connection to one another in the same dispositions as they has during their temporary interconnection on the assembly line 7. It has been found that manufacturing tolerances are of no great consequence when this method of construction is employed as the final building, or building story, is re-erected on its permanent site with its component sections or units in exactly the same relative dispositions as they had while being finished during their movement along the assembly line 7.

The generally L-shaped plan of the production line on the factory floor 1 has certain advantages. The final depots or stations of the assembly line 7 are located in an area of the factory floor which is well separated from the other working areas so that, consequently, the final operations, and particularly the exterior painting, can be effected with a minimum of disturbance and with a minimum exposure to damage and to air-borne dust and the like while the paint is wet. The relatively perpendicular arrangements of the lengths of the manufacturing line 10 and assembly line 7 essentially involve a 90° change of direction of motion at the mounting depot or station 35 so that there is no need for specialized equipment for altering the direction of conveyor paths, crane conveyors and the like. The manufacturing line 10 is divided into closely adjacent but separate sub-lines in such a way that the prefabricated panel elements constructed thereon reach the mounting depot or station 35 in generally correct relative dispositions for the assembly of the building sections or room units such as those indicated by the references 51 to 55 in FIG. 1 of the drawings. After the walls 81 and 82 have been brought to vertical dispositions, they have only to be welded to the floors 80 and ceilings 83. The generally L-shaped disposition of the production line also provides an efficient arrangement of the subsidiary assembly line 24 upon which the frames 87 and 89 and metal beams 84 and 85 are produced. These essential metal parts are delivered direct to the receiving end of the manufacturingg line 10 and all of the components and equipment stores are located internally of the area that is partially bounded by the generally L-shaped production line. This renders all of the various stores readily accessible from a central area of the factory floor 1 so that the construction workers, office staff and other operatives can reach the stores without having long distances to travel. Accordingly, main stores 71 and 72 are located approximately centrally of the factory floor 1 near the office 4 so that they are readily accessible to all the different manufacturing and assembly areas of the production line and so that the office staff can readily check upon the receipt of materials by the stores 71 and 72. Bulk stores for cement, sand, gravel and other such materials are separate from the stores which have so far been mentioned and are preferably located at a readily accessible site close to, but outside, the enclosed space of the factory floor 1. Nevertheless, supplies of such materials for immediate use are contained in the reservoirs 18 to 21 in very close proximity to the concrete mixer 17 at the receiving end of the manufacturing line 10 which comprises the concrete-receiving moulds. Thus, the distances between the reservoirs 18 to 21, the concrete mixer 17 and the moulds on the line 10 are all very short. As the assembly line 7 is disposed along the long limb of the generally L-shaped production line, its free end terminates near a relatively empty region of the floor 1 in which region there is sufficient space available for the erection of a demonstration or show house or bungalow 70. The demonstration or show house or bungalow 70 is located close to the main entrance to the factory in a region thereof where the noise level will be relatively low so that potential customers and other persons can be received and entertained without undue disturbance.

It will be self-evident that the prefabricated building sections or room units that are produced in accordance with the invention may be used for purposes other than dwelling houses and bungalows. They are equally suitable for the construction of office buildings, schools, hospitals and business premises of many kinds. It is particularly advantageous to construct the walls, floors and/or ceilings of the prefabricated sections or units from concrete and steel beams because the panel elements which those beams and concrete fillings define are very strong without being unduly heavy and have very high resistance to mechanical shocks, such as earth quakes, tending to cause deformations. The modular cell-like construction of the individual building sections or room units allows a bungalow, dwelling house or other building from which they are formed to be finished to a very large extent in the factory before delivery to the erection site. Since the method of manufacture which has been described is a very economic one, the buildings which result therefrom can be made available at a favorable and competitive price. Also, because very little finishing work is necessary on the actual building or erection site, a bungalow, dwelling house or other building can be erected in a very short time which may be as little as a few hours.

Although various features of the prefabricated building sections or room units, and their method of manufacture, that have been described and/or illustrated will be set forth in the following claims as inventive features, it is emphasized that the invention is not necessary limited to those features and that it includes within its scope all of the parts and manufacturing steps that have been described and/or illustrated both individually and in various combinations.

What we claim is:

1. A method of manufacturing prefabricated sections for a building wherein each section defines at least two walls of a room and has a length substantially longer than its width, the method comprising the steps of: producing panel elements comprising floors and ceilings for each section on a manufacturing line and moving said floors and ceilings thereon, and producing further panel elements comprising said walls on said manufacturing line, orienting the positions of said floors, and ceilings while being produced throughout said manaufacturing line whereby they are correctly orientated when arriving at a mounting station at the end of said manufacturing line for the positions they will occupy in the completed section; locating said floors at selected locations at said mounting stations without changing their relative orientation and assembling said floors and ceilings without changing their relative individual longitudinal orientations and said walls into their permanent positions in said building sections at said locations at said mounting station at the end of said manufacturing line; moving a plurality of said assembled sections onto the beginning of an assembly line without substantially modifying their relative individual longitudinal orientations and having substantially the relative relationship they will occupy in the assembled building; joining said plurality of said sections so placed on said assembly line in the relationship they will have in the assembled building; and finishing said plurality of sections on said assembly line while so joined together.

2. A method as claimed in claim 1, wherein the method includes the steps of forming each of said panel elements by providing a concrete like cementitious filling between metal beams, which then become parts of each said elements, conveying the formed elements to said mounting station, and welding the beams of said elements to one another at said mounting station to produce building sections of cellular form for subsequent operations on said assembly line.

3. A method as claimed in claim 2, wherein the filling is produced by casting concrete like cementitious material in a mold, the metal beams of said elements being appropriately disposed in the mold prior to the casting of said concrete like cementitious material.

4. A method as claimed in claim 3, wherein metal reinforcement members are secured to the metal beams prior to the casting of the concrete like cementitious material.

5. A method as claimed in claim 3, wherein there is a step of arranging pipes, conduits and like ducts between the metal beams prior to said step of casting of the concrete like cementitious material between them.

6. A method as claimed in claim 1, wherein said panel elements destined for use as ceilings are formed by disposing ceiling sheets on frames afforded by assemblies of said beams.

7. A method as claimed in clain 1, wherein said panel elements and said prefabricated building sections are moved, during their production, along a production line having a total length which exceeds the greatest rectilinear dimension of the factory floor which accommodates said production line.

8. A method as claimed in clain 3, wherein said casting molds are subjected to a current of hot air after receiving said cementitious material.

9. A method as claimed in claim 3, wherein said beams are welded to one another to form frames prior to the provision of the filling.

10. A method as claimed in claim 3, wherein the building sections are conveyed along four rails which form at least part of an assembly line,

11. A method as claimed in claim 9, wherein said panel elements intended to form walls of said building sections are made by providing a filling of cementitious material between two horizontal beams and subsequently disposing said panel elements in upright positions in such a way that said two beams constitute lateral supports of those elements.

12. A method as claimed in claim 11, wherein said sections are moved along said assembly line in a step-by-step manner.

13. A method as claimed in claim 1, wherein said panel elements intended to form ceilings of the building sections are moved along a roller conveyor in horizontal orientations during their manufacture.

14. A method as claimed in claim 13, wherein said panel elements intended to form ceilings are supplied to said mounting station from overhead.

15. A method as claimed in claim 1, wherein said manufacturing line extends at right-angles to said assembly line.

16. A method as claimed in claim 4, wherein a concrete mixer is arranged in close proximity to said manufacturing line.

17. A method as claimed in claim 4, wherein said panel elements are formed by providing fillings between lateral metal beams.

18. A method as claimed in claim 4, wherein said panel elements are connected to one another at said station by corners at the ends of the metal beams to form the building sections.

19. A method as claimed in claim 18, wherein said metal beams of said panels elements are welded to one another at the corners of such elements.

20. A method as claimed in claim 17, wherein the metal portions of said panel elements are provided with an antioxidant composition prior to the completion of such panel elements.

21. A method as claimed in claim 4, wherein said building sections are furnished with interior parts on said assembly line during at least one step of the method.

22. A method as claimed in claim 1, wherein a final step in said method comprises the disconnection of said sections for separate transport to a store or erection site.

23. A method as claimed in claim 4, wherein a plurality of panel elements are formed substantially entirely from steel and concrete and at least one further panel element is formed from steel and an alternative filling material.

24. A method as claimed in claim 4, wherein the finished panel elements are supplied to the mounting station in a direction transverse to the longitudinal direction of an assembly line wherein said sections are connected to form a building.

25. A method of manufacturing prefabricated sections for a building wherein each section defines at least two walls of a room and is rectangular in plan, the method comprising the steps of: producing panel elements comprising floors and ceiling for each section on a manufacturing line in a first direction parallel to the longer sides of said floors and said ceilings, and also producing further panel elements comprising said walls on said manufacturing line, whereby said floors and ceiling are correctly oriented while being produced throughout said manufacturing line when arriving at a mounting station at the end of said manufacturing line for the positions they will occupy in the completed section; assemblying said floors and ceilings without changing their orientation and said walls into their permanent positions in said building sections at said mounting station at the end of said manufacturing line; connecting a plurality of said sections at said mounting station in substantially the relative position they will occupy in the assembled building and moving said plurality of said connected sections onto the beginning of an assembly line without substantially modifying the orientation thereof; and finishing said plurality of sections on said assembly line.

26. A method of manufacturing prefabricated sections for a building wherein each section defines at least two walls of a room and has a length substantially longer than its width, the method comprising the steps of producing metal frames for the floors and ceiling and introducing said frames on a manufacturing line with their longer lengths parallel to the direction of movement on said manufacturing line, providing further metal beams for defining said walls on said manufacturing line, molding the floors, ceilings and walls on said manufacturing line by filling said floor frames and between said metal beams for said walls with cementitious material and allowing said material to harden secured to said metal beams while on said manufacturing line, conveying said floors, ceilings and walls to a mounting station at the end of said manufacturing line in the approximate orientation they will occupy in the building sections, assemblying said floors, ceilings and walls into building sections at said mounting station at the end of said manufacturing line, moving said assembled sections on the beginning of an assembly line adjacent to the end of said manufacturing line and at right angles thereto with the longer length of such sections being transverse to the direction of movement of said assembly line, said movement of said sections being accomplished without substantial change to the longitudinal orientation of such sections, joining a plurality of sections together on said assembly line in the relationship they will have in the assembled building, and finishing said plurality of sections on said assembly line while joined together.

27. A method of manufacturing prefabricated sections for a building wherein each section defines at least two walls of a room and has a length substantially greater than its width, the method comprising the steps of:

producing rectangular metal frames for the floors and introducing said frames in a horizontal disposition on a manufacturing line with their lengths parallel to the direction of movement thereon;

filling said frames with cementitious material while on said manufacturing line while utilizing said frame at least in part as a mold for receiving said cementitious material, and allowing said material to harden in a secured relationship to said frame while on said manufacturing line with their lengths remaining parallel to the direction of movement thereon, moving said floors without substantially changing their longitudinal orientation to the beginning of an assembly line adjacent to the end of said manufacturing line and at right angles therewith, the lengths of said floors being thereby placed transverse to the direction of movement of said assembly line and in substantially the same relationship they will have in the assembled building, interconnecting a plurality of said floors together in the relationship they will have in the assembled building; and moving said floors in their connected relationship on said assembly line while further building components are added thereto.

28. A method of manufacturing prefabricated sections for a building wherein each section defines at least two walls of a room and has a length substantially longer than its width, the method comprising the steps of:

producing rectangular metal frames for the floors and ceiling and introducing said frames on a manufacturing line with their longer lengths parallel to the direction of movement on said manufacturing line;

providing further metal beams for defining said walls on said manufacturing line;

preparing ceiling panels by filling said metal frames for the ceilings on said manufacturing line with an appropriate material therefor and preparing floor and wall panels by molding floors and walls on said manufacturing line by introducing in said floor frames and providing between said metal beams for said walls cementitious material, and allowing said cementitious material to harden secured to said metal beams while on said manufacturing line;

conveying said floor, ceiling and wall panels to a mounting station at the end of said manufacturing line, assemblying said floor, ceiling and wall panels into building sections at said mounting station at the end of said manufacturing line;

moving said assembled sections on the beginning of an assembly line adjacent to the end of said manufacturing line and moving said sections along said assembly line with the longer length of said sections being transverse to the direction of movement of said sections along said assembly line, said movement of said sections from said mounting station onto said assembly line being accomplished without substantial change to the longitudinal orientation of each said section; and finishing said sections along said assembly line.

29. The method of manufacturing prefabricated sections wherein each section defines at least two walls of a room and is elongated whereby its length is substantially longer than its width, the method comprising the steps of: producing rectangular metal frames for the floors of said sections, introducing said frames on a manufacturing line with their longer length parallel to the direction of movement along said manufacturing line; providing further metal beams for defining said walls on said manufacturing lines; preparing floor panels and wall panels on said manufacturing line by introducing in said floor frames and providing between said metal beams for said walls while in horizontal disposition concretive material in a plastic state which has the characteristic of solidifying and hardening, and allowing said concretive material to harden secured to said metal beams on said manufacturing lines; providing ceiling panels with metal frames adapted to be received and secured to said wall panels; conveying said floor, ceiling and wall panels to a mounting station disposed at the end of said manufacturing line, assembling said floor, ceiling and wall panels into building sections at said mounting station; moving said assembled sections onto the beginning of an assembly line adjacent to the end of said manufacturing line and moving said sections along said aassembly line with the longer length of said sections being transverse to the direction of movement of said sections from said mounting station and along said assembly line being accomplished without substantial modification of the longitudinal orientation of each of said sections; and finishing said sections along said assembly line.

* * * * *